United States Patent [19]

Skolaude

[11] 4,279,631

[45] Jul. 21, 1981

[54] PROCESS AND APPARATUS FOR THE PRODUCTION OF OXYGEN BY TWO-STAGE LOW-TEMPERATURE RECTIFICATION OF AIR

[75] Inventor: Werner Skolaude, Grünwald, Fed. Rep. of Germany

[73] Assignee: Linde Aktiengesellschaft, Fed. Rep. of Germany

[21] Appl. No.: 734,090

[22] Filed: Oct. 20, 1976

Related U.S. Application Data

[63] Continuation-in-part of Ser. No. 712,263, Aug. 6, 1976, abandoned.

[30] Foreign Application Priority Data

Aug. 6, 1975 [DE] Fed. Rep. of Germany ..... 2535132

[51] Int. Cl.[2] ..... F25J 3/02

[52] U.S. Cl. ..... 62/29; 62/38

[58] Field of Search ..... 62/29, 38

[56] References Cited

U.S. PATENT DOCUMENTS

| | | | |
|---|---|---|---|
| 3,083,544 | 4/1963 | Jakob | 62/29 |
| 3,216,206 | 11/1965 | Kessler | 62/30 |
| 3,947,259 | 3/1976 | Frischbier | 62/38 |

*Primary Examiner*—Hiram H. Bernstein

*Attorney, Agent, or Firm*—Millen & White

[57] ABSTRACT

In a process for the production of oxygen by two-stage low-temperature rectification of air wherein the air is cooled in a primary heat exchanger, and the product oxygen is withdrawn from the low-pressure stage and warmed by heat exchange in a heat exchanger separate from the primary heat exchanger with a gaseous stream fed to the high-pressure stage, a gaseous stream fed to the high-pressure stage, a gaseous stream being withdrawn as the compensating stream from the high-pressure stage, warmed at least partially in the primary heat exchanger countercurrently to the entering air, and expanded in at least one turbine, the improvement which comprises recooling the compensating stream prior to entering the turbines, by heat exchange with the product oxygen in said heat exchanger separate from the primary heat exchanger.

9 Claims, 3 Drawing Figures

PROCESS AND APPARATUS FOR THE PRODUCTION OF OXYGEN BY TWO-STAGE LOW-TEMPERATURE RECTIFICATION OF AIR

This application is a continuation-in-part of application Ser. No. 712,263, filed Aug. 6, 1976, now abandoned.

This invention relates to a process and apparatus for the production of oxygen by two-stage low-temperature rectification of air wherein the air is cooled in a primary heat exchanger, and the product oxygen is withdrawn from the low-pressure stage and warmed by heat exchange in a heat exchanger separate from the primary heat exchanger with a gaseous stream fed to the high-pressure stage, a gaseous stream being withdrawn as the compensating stream from the high-pressure stage, warmed at least partially in the primary heat exchanger countercurrently to the entering air, and expanded in at least one turbine.

In a conventional method of this type for the production of oxygen, the entering air is cooled in a primary heat exchanger against exiting gas and forced into the high-pressure column for rectifying purposes. The liquid product oxygen withdrawn from the sump of the low-pressure column is compressed in a pump and discharged from the plant by way of a heat exchanger. During this procedure, the liquid product oxygen yields its cold to a gaseous stream fed to the high-pressure stage, this gaseous stream being compressed before entering the heat exchanger to increase its specific heat. To maintain the desired small temperature differences in the primary heat exchanger, a gaseous stream is withdrawn from the high-pressure column as the compensating stream, a portion thereof conducted countercurrently to the entering air in the primary heat exchanger, and expanded in a turbine. In this mode of operating the process, considerable amounts of energy are required to compress the gaseous stream conducted countercurrently to the product oxygen in the heat exchanger.

The invention is based on the object of finding a mode of operation for this process making it possible to operate with a smaller amount of gas for the warming of the product oxygen, in order to thereby save compression energy.

This object is attained by recooling the compensating stream before entering the turbine by heat exchange with the product oxygen in that heat exchanger provided separately from the primary heat exchanger.

The cooling step is conducted preferably down to the temperature of the evaporating oxygen. Due to this measure of the invention, the quantity of the gaseous stream necessary to warm the product oxygen can be considerably reduced.

A portion of the compensating stream not required for maintaining the desired temperature difference in the primary heat exchanger can be conventionally branched off before entering the primary heat exchanger and can be admixed again to the exiting compensating stream. The mixing of two streams of different temperatures means a loss in exergonic property, i.e. a loss in work-producing heat. In accordance with an especially advantageous embodiment of the present invention, this loss in exergonic property is avoided by warming the portion of the compensating stream, which has circumvented the primary heat exchanger, prior to entering the turbine in parallel conductance with the product oxygen. Moreover, this mode of operation also has an advantageous effect on the temperature difference at the cold end of the heat exchanger.

The process of this invention can be utilized with advantage if air is employed as the compensating stream which is withdrawn from the lower portion of the high-pressure stage, preferably between the second and third plates thereof, and introduced into the low-pressure column after the turbine expansion.

In accordance with another advantageous embodiment of the present invention, nitrogen is utilized for the compensating stream which is withdrawn from the head of the high-pressure column and leaves the plant after the turbine expansion step by way of the primary heat exchanger.

In the same way, the process of this invention can also be used advantageously if compressed nitrogen is employed for warming the product oxygen; this compressed nitrogen is withdrawn from the head of the high-pressure column, warmed in the primary heat exchanger, compressed, and cooled in heat exchange with the product oxygen, and is then reintroduced under throttling in a controlled manner into the high-pressure column for the production of cold.

The use of the process according to this invention is likewise of advantage if a portion of the feed air is utilized for warming the product oxygen, which air is introduced under throttling into the sump of the high-pressure stage after further compression and after heat exchange with the product oxygen. For the conducting of the process of this invention, an apparatus with a heat exchanger is suitable, the latter having a flow cross section in communication on the outlet side with the turbines.

If it is furthermore desired to warm a portion of the compensating stream not required for maintaining the desired temperature differences in the primary heat exchanger before this portion enters the turbines, it is advantageous to use an apparatus having a bypass conduit which conducts this portion of the compensating stream via the heat exchangers for the product oxygen.

FIG. 1 shows a schematic view of a plant for the air separation with a nitrogen cycle wherein air is utilized as the compensating stream.

FIG. 2 shows a schematic view of a plant as illustrated in FIG. 1, except that nitrogen is utilized for the compensating stream.

FIG. 3 shows a schematic process diagram.

Figure 1:
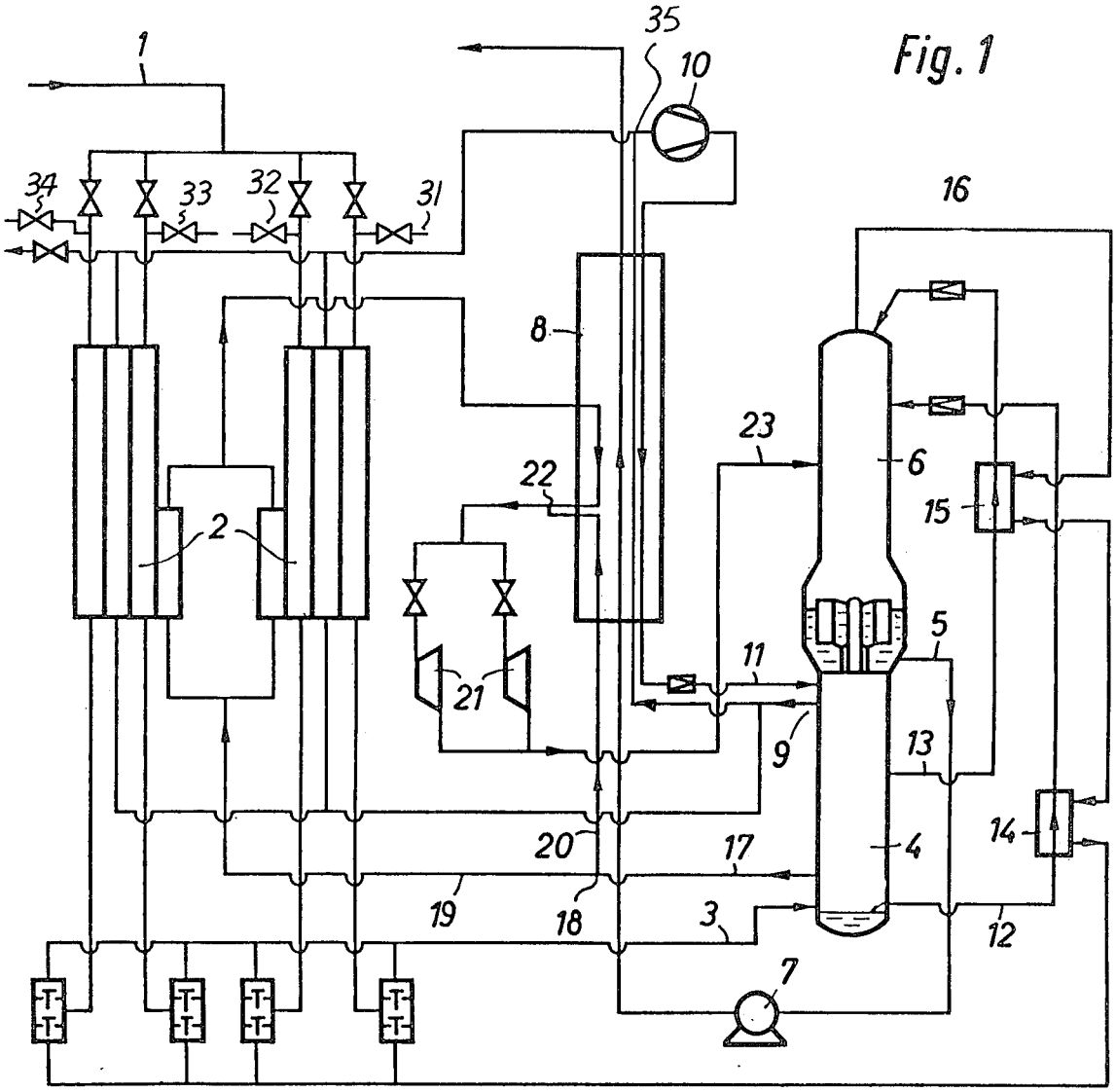
FIGS. 1–3 illustrate the invention in greater detail with the aid of two embodiments and a diagram, to wit.
Figure 2:
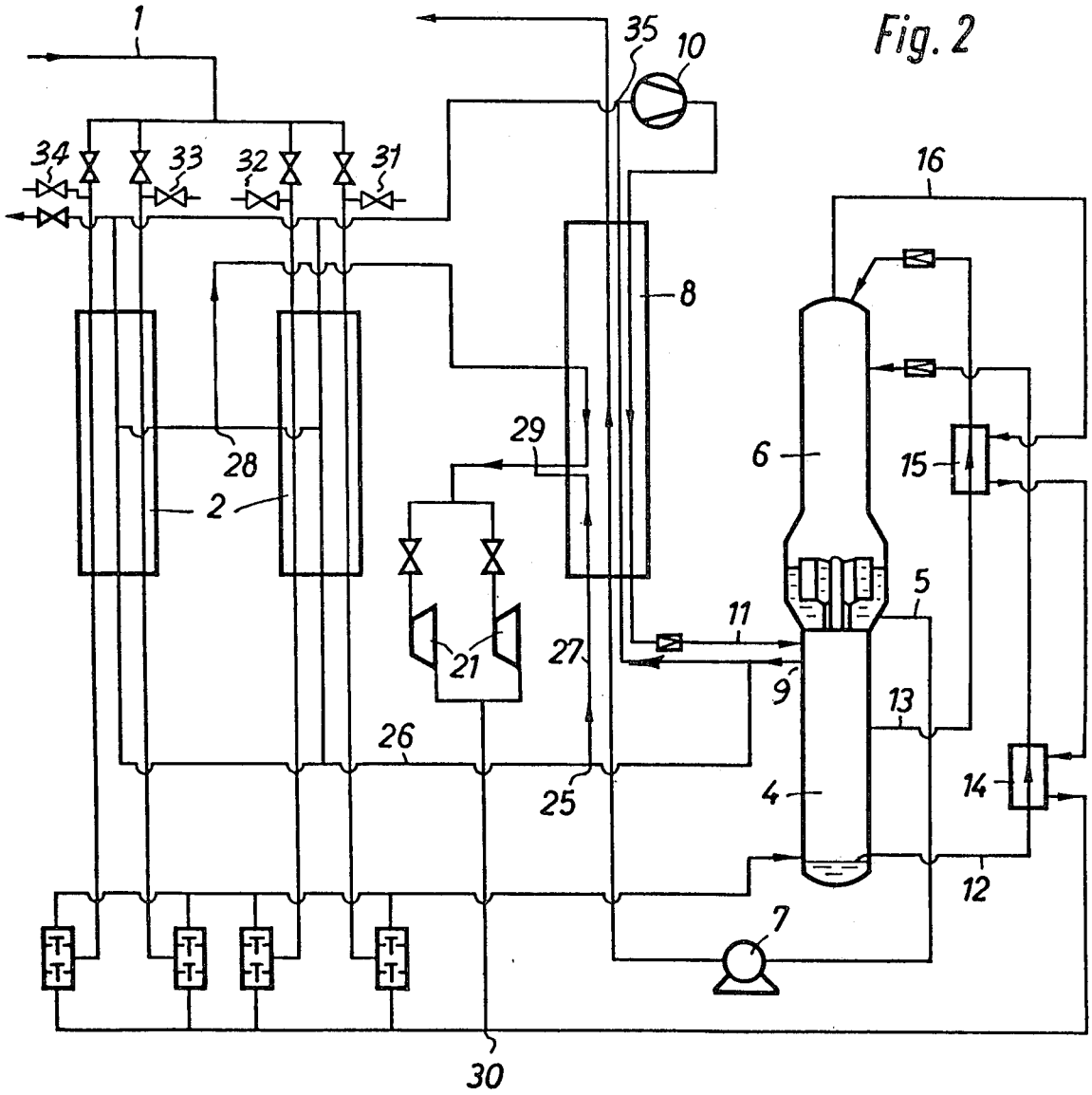

Identical parts in FIGS. 1 and 2 are denoted by the same reference numerals.

Reversing exchangers are denoted by numeral 2. The high-pressure column is denoted by 4, and the low-pressure column bears numeral 6. Furthermore, numeral 8 denotes a heat exchanger, 21 denotes expansion turbines, and 10 is a compressor.

The prepurified, compressed air in FIG. 1 enters the plant at 1 via the reversing exchangers 2 and is introduced at 3 into the high-pressure column 4. Product oxygen withdrawn at 5 from the low-pressure column 6 in the liquid phase is compressed in a pump 7 and discharged from the plant through the heat exchanger 8. At 9, gaseous nitrogen is withdrawn from the head of the high-pressure column, warmed in the reversing exchangers 2, compressed in the compressor 10, cooled in heat exchanger 8, and introduced under throttling as 11 into the high-pressure column 4. Via conduits 12 and 13, crude oxygen or nitrogen is withdrawn from the high-pressure column, conducted via the heat exchangers 14 and 15, respectively, and introduced under throttling into the low-pressure stage. The nitrogen-containing residual gas is conducted out of the plant via conduit 16 by way of the heat exchangers 14, 15, and the reversing exchangers 2, and leaves the plant by lines 31 and 33 or by lines 32 and 34 according to the particular switching phase of the reversing exchangers.

Air is withdrawn at 17 between the second and third plates of the high-pressure column 4 having about 40 to 50 plates and branched at 18 into two partial streams 19 about 50 to 90%, and 20 about 50 to 10%. The partial stream 19 is warmed in the reversing exchangers 2, withdrawn before the heat equalization has been completed, and cooled according to this invention in heat exchanger 8 prior to entering the turbines 21. In accordance with the invention, the partial stream 20 is warmed in heat exchanger 8, mixed with the partial stream 20 at 22 and fed to the turbines 21. The expanded air is introduced into the low-pressure column 6 at 23.

FIG. 2 shows schematically the utilization of the mode of operation according to this invention for those air separating plants wherein nitrogen is employed for the compensating stream. The schematic view differs from that illustrated in FIG. 1 by the following items:

At 9, gaseous nitrogen is withdrawn from the head of the high-pressure column 4 and branched into two partial streams 26 (about 30 to 32%) and 27 (about 70 to 68%) at 25. The partial stream 26 is conducted through the reversing exchangers 2 to the compressor 10. A portion thereof is withdrawn from the reversing exchangers at 28 before the heat equalization has been completed and, in accordance with the invention, is cooled in heat exchanger 8 prior to entering the turbines 21. The partial stream 27 is warmed, according to this invention, in heat exchanger 8, mixed with the partial stream 26 at point 29, and introduced into the turbines 21. The expanded gas is mixed with the residual gas at 30 and leaves the plant by way of the reversing exchangers 2.

Figure 3:
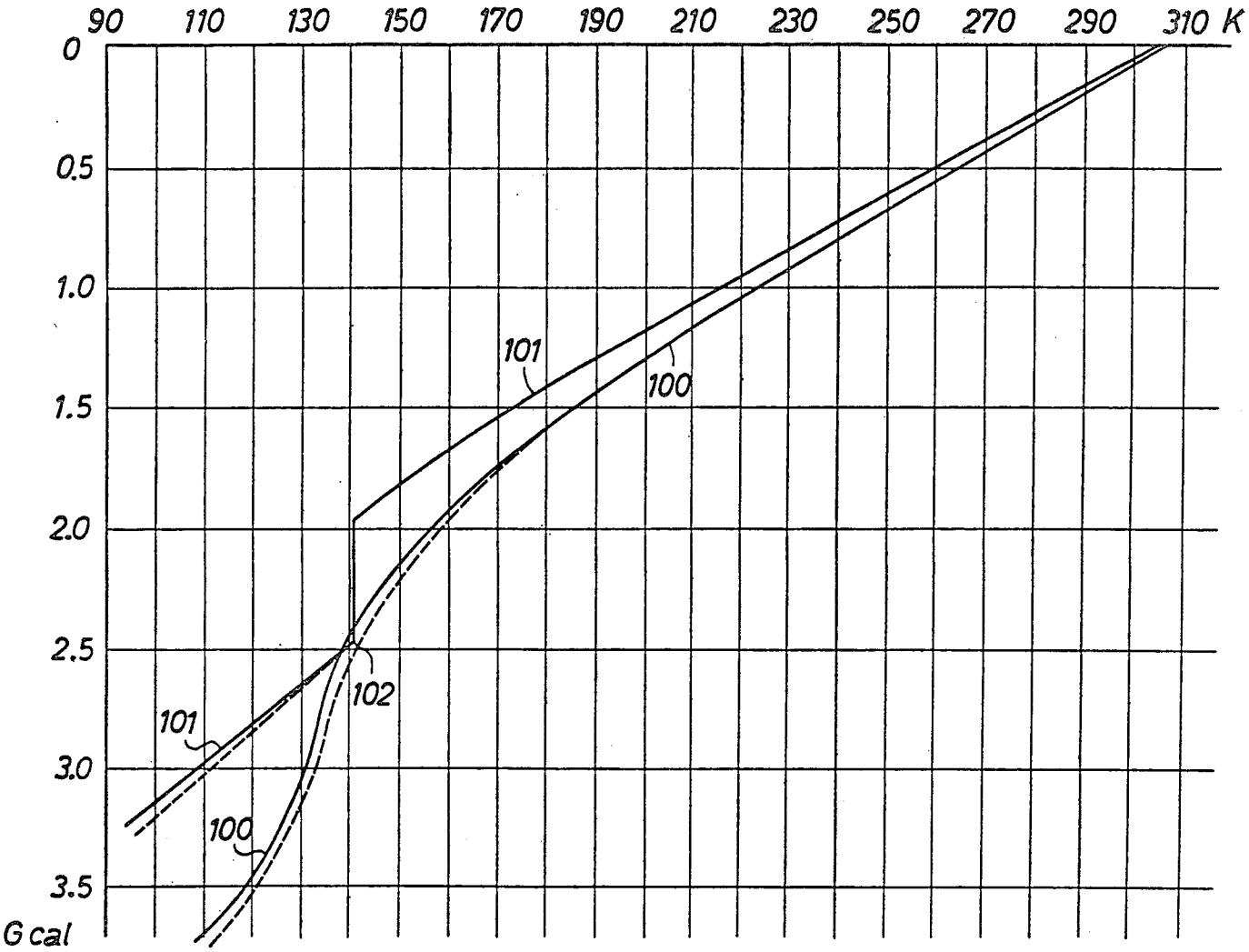

FIG. 3 shows schematically the enthalpy curve of the streams 100 to be cooled in heat exchanger 8 (FIG. 2) and of the streams 101 to be warmed, as a function of the temperature. The temperature is plotted on the abscissa in degrees Kelvin, and the enthalpy is plotted on the ordinate in Gcal. It can be seen that the two curves approach each other most closely at the boiling point of the product oxygen 102. The quantity of the gaseous stream necessary for warming the product oxygen thus is determined essentially by this point. The curves in dashed lines show the course of the streams to be cooled when the process of this invention is conducted. By changing the curve characteristic, a greater minimum temperature difference results or, respectively, the product oxygen can be warmed, at a predetermined temperature difference, with a smaller quantity of gas, whereby the aforementioned saving in compression energy is attained.

Thanks to the above-described mode of operating the process in accordance with this invention, it is possible, in a plant producing 11,800 $Nm^3/h$. of oxygen, to reduce the quantity of cycle nitrogen which must be compressed in compressor 10 from 3,850 $Nm^3/h$. to 3,350 $Nm^3/h$. In total, this yields a saving in energy of at least 6% in plants of the above-mentioned size.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight. In the method according to FIG. 1 60,600 $Nm^3/h$ prepurified and compressed air are cooled to dewpoint in reversing exchangers 2. Due to losses caused by switching of the reversing exchangers only 60,300 $Nm^3/h$ per average are introduced into the high-pressure column which is operated under a pressure of about 6.35 to 6.1 bar. 31,000 $Nm^3/h$ of liquid crude oxygen are withdrawn from the sump of column 4 (line 12) and are introduced into the upper column which is operated under a pressure of 1.56 bar. 21,900 $Nm^3/h$ of liquid nitrogen are also withdrawn from the lower column (line 13) and introduced into the upper column under throttling. 34,900 $Nm^3/h$ nitrogen are withdrawn by line 9 from the lower column 4. One part thereof (12,900 $Nm^3/h$) is warmed in reversing exchangers 2, another part is warmed in heat exchanger 8 to approximately ambient temperature. Both parts are reunited at point 35 and led to the suction side of compressor 10. In the compressor 10 this stream is compressed to 50 bars and after removing the heat of compression further cooled in heat exchanger 8, throttled to about 6.1 bar and introduced (line 11) into the top of the pressure column. 11,800 $Nm^3/h$ product oxygen are withdrawn by line 5 and compressed in liquid form to about 32 bar in pump 7. The product oxygen is withdrawn from the plant after being heated in heat exchanger 8.

5,000 $Nm^3/h$ of a gas which has in principle the same composition as air are withdrawn from the pressure column by line 17. A first portion thereof (3,500 $Nm^3/h$) is tapped off at point 18 and warmed in heat exchanger 8 to approximately 141 K. The second portion is heated in reversing exchangers 2 to about 175 K. and is then cooled according to the invention in heat exchanger 8 to about 141 K. Both portions are reunited at pointed 22 and workexpanded in turbines 21, whereby this stream is cooled to about 101.5 K. The expanded stream is conducted to the low pressure column by line 23.

The preceding examples can be repeated with similar success by substituting the generically or specifically described reactants and or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the production of oxygen by two-stage low-temperature rectification of air wherein the air is cooled in a primary heat exchanger, and the product oxygen is withdrawn from the low-pressure stage in the liquid phase, pumped to a higher pressure and warmed by heat exchange in a secondary heat exchanger separate from the primary heat exchanger with a high-pressure gaseous stream fed to the high-pressure stage, said high-pressure gaseous stream, during the heat exchange in the secondary heat exchanger, having a substantially higher pressure than the high-pressure stage, the improvement which comprises withdrawing a second gaseous stream as the compensating stream from the high-pressure stage, warming said compensating stream at least partially in the primary heat exchanger countercurrently to the entering air, recooling the warmed compensating stream by heat exchange with the product oxygen in said secondary heat exchanger separate from the primary heat exchanger, said warmed compensating gas during the heat exchange having substantially the same pressure as the high-pressure stage, both said high-pressure gaseous stream to the high-pressure stage and said warmed compensating stream being employed in separate conduits and cocurrently to vaporize the liquid oxygen product countercurrently in said secondary heat exchanger, and turbine-expanding resultant warmed compensating stream.

2. Process according to claim 1, wherein a partial stream is branched off from the compensating stream prior to entering the primary heat exchanger, warmed cocurrently to the product oxygen and countercurrently to the gaseous stream fed to the high-pressure stage by heat exchange, and recombined with the recooled compensating stream prior to the entering of the latter into the turbines.

3. Process according to claim 1, wherein air is utilized for the compensating stream which is withdrawn from the lower portion of the high-pressure stage and, after expansion in the turbines, introduced into the low-pressure stage.

4. Process according to claim 1, wherein nitrogen is employed for the compensating stream and is withdrawn from the head of the high-pressure stage.

5. Process according to claim 1, wherein the gaseous stream fed to the high-pressure stage is nitrogen, withdrawn from the head of the high-pressure stage, warmed at least in part in the primary heat exchanger, compressed, and after heat exchange with the product oxygen, is introduced under throttling into the head of the high-pressure stage.

6. Process according to claim 1, wherein the gaseous stream fed to the high-pressure stage is a portion of the feed air, which portion, after further compression and after heat exchange with the product oxygen, is introduced under throttling into the sump of the high-pressure stage.

7. Apparatus for fractionating air comprising a two-stage rectifying column, a primary heat exchanger, at least one turbine, a pressurized compensating stream cycle, a liquid oxygen pump, a secondary heat exchanger (8) containing a liquid to gas flow cross section for evaporating the liquid product oxygen and provided with a first gaseous flow cross section for the compensating stream for heating the oxygen, this flow cross section being connected on the outlet side to the turbines (21), a second gaseous flow cross section for high-pressure gas for heating the oxygen and leading to the high-pressure stage, and a bypass conduit conducting a portion of the compensating stream from the high-pressure stage past the primary heat exchanger into the turbines, the bypass conduit traversing the heat exchanger (8) for the product oxygen and forming a third gaseous flow cross section within said secondary heat exchanger.

8. A process according to claim 2, wherein the branched-off partial stream comprises about 10–50% of the compensating stream.

9. A process according to claim 4, wherein about 68–70% of the nitrogen compensating stream withdrawn from the head of the high-pressure column is branched-off and passed directly through said secondary heat exchanger.

* * * * *